US005552668A

United States Patent [19]

Hirose et al.

[11] Patent Number: 5,552,668

[45] Date of Patent: Sep. 3, 1996

[54] SELF-WATERPROOFING ELECTROLUMINESCENT DEVICE

[75] Inventors: Koji Hirose; Shigehiko Aoki, both of Tokyo, Japan

[73] Assignee: Seiko Precision Inc., Tokyo, Japan

[21] Appl. No.: 322,006

[22] Filed: Oct. 12, 1994

[30] Foreign Application Priority Data

Oct. 15, 1993 [JP] Japan ..... 5-258387
Jul. 26, 1994 [JP] Japan ..... 6-174226

[51] Int. Cl.[6] ..... H01J 1/62

[52] U.S. Cl. ..... 313/506; 313/509; 313/512

[58] Field of Search ..... 313/506, 509, 313/504, 502, 512; 528/102, 104; 424/421, 690

[56] References Cited

U.S. PATENT DOCUMENTS 4,647,402 3/1987 Tamura ..... 252/511
4,876,481 10/1989 Taniguchi et al. ..... 313/506
5,164,799 11/1992 Uno ..... 313/506
5,321,083 6/1994 Hanada et al. ..... 525/102
5,427,858 6/1995 Nakamura et al. ..... 313/512

*Primary Examiner*—Sandra L. O'Shea
*Assistant Examiner*—Vip Patel
*Attorney, Agent, or Firm*—Amster, Rothstein & Ebenstein

[57] ABSTRACT

An electroluminescent device having improved moisture resistance. The device comprises a transparent substrate having a transparent electrode layer. A luminescent layer and a dielectric layer are interposed between the transparent electrode layer and a back electrode layer. The luminescent layer comprises a resinous binder containing electroluminescent particles. The dielectric layer comprises a resinous binder containing dielectric particles. The back electrode layer comprises a resinous binder containing conductive particles. The resinous binder of at least one of the luminescent layer and the dielectric layer is made from a fluoride resin. A reaction accelerator for promoting polymerization of the fluoride resin is contained in the back electrode layer.

7 Claims, 7 Drawing Sheets

SELF-WATERPROOFING ELECTROLUMINESCENT DEVICE

FIELD OF THE INVENTION

The present invention relates to an electroluminescent device which can be used in display devices for various apparatuses, in a backlighting arrangement, and in other devices.

BACKGROUND OF THE INVENTION

A conventional electroluminescent device is fabricated in the manner described now. A transparent electrode layer consisting of indium tin oxide (ITO) is deposited on a transparent substrate which is made of a sheet of polyethylene terephthalate or the like. A luminescent layer, a dielectric layer, and a back electrode layer are laminated on the transparent electrode lying on the transparent substrate. These are sealed by transparent moisture-proof film, thus completing the electroluminescent device.

In this prior art technique, it is common practice to use a cyanoethylated resin as a resinous binder for both luminescent layer and dielectric layer. However, this cyanoethylated resin has the disadvantage that it is highly hygroscopic. On the other hand, the electroluminescent material in the luminescent layer is severely deteriorated by intrusion of moisture. Therefore, in order to protect the electroluminescent material against moisture and to improve the durability, it is essential that the electroluminescent device be sealed by moisture-proof film. Consequently, in the prior art technique, the necessity of the moisture-proof film increases the thickness of the electroluminescent device itself accordingly and decreases its flexibility. Because the moisture-proof film must have a mating space along its outer periphery, the luminescent area is smaller than the two-dimensional size of the electroluminescent device. Furthermore, the moisture-proof film is expensive. Hence, the cost to fabricate the electroluminescent device that needs a sealing step is increased.

A first improved technique for dispensing with the moisture-proof film is described by Timex Corporation in U.S. Pat. No. 4,775,964 relating to a luminescent dial on a watch. In this improved technique, epoxy resin is used as the resinous binder for the luminescent layer. This luminescent dial is installed in a watch case that is a confined narrow space and so this technique can be put into practical use. However, if it is used under an exposed state, the moisture resistance and durability are not satisfactorily high. Furthermore, there is room for improvement of the luminescent brightness.

Meanwhile, we have already proposed an improved electroluminescent device in Japanese patent application No. 231709/1993. In particular, a binder consisting of a fluoride resin is used, so that moisture-proof film can be dispensed with. In addition, high luminescent brightness can be obtained. However, it cannot be said that this second improved technique provides complete moisture resistance.

SUMMARY OF THE INVENTION

Accordingly, it is an object of the present invention to provide an electroluminescent device using a binder made from a fluoride resin to thereby dispense with moisture-proof film and to improve the moisture resistance and durability of the device.

The above object is achieved in accordance with the teachings of the invention by an electroluminescent device in which a luminescent layer and a dielectric layer are interposed between a transparent electrode layer and a back electrode layer. The luminescent layer comprises a resinous binder that contains electroluminescent particles. The dielectric layer comprises a resinous binder that contains dielectric particles. The back electrode layer comprises a resinous binder that contains conductive particles. This device is characterized in that the resinous binder of at least one of the luminescent layer and the dielectric layer is made from a fluoride resin, and that a reaction accelerator for promoting polymerization of the fluoride resin binder is contained in the back electrode layer.

In another electroluminescent device according to the invention, a luminescent layer and a dielectric layer are interposed between a transparent electrode layer and a back electrode layer. The luminescent layer comprises a resinous binder that contains electroluminescent particles. The dielectric layer comprises a resinous binder that contains dielectric particles. This device is characterized in that the resinous binder of at least one of the luminescent layer, the dielectric layer, and the back electrode layer is made from a fluoride resin, and that a protective layer made from an electrically insulating resin is formed on an outer surface of the back electrode layer. A reaction accelerator for promoting polymerization of the fluoride resin is contained in the protective layer.

Preferably, the reaction accelerator is an organic silicon monomer having two or more different reaction groups per molecule. Preferably, the amount of the reaction accelerator added to the back electrode layer is more than 2% by weight. Preferably, the end portion of the back electrode layer is retreated slightly from the end portion of the electroluminescent device, taking account of deterioration of the end surfaces of the outer periphery of the luminescent layer.

Other objects and features of the invention will appear in the course of the description thereof, which follows.

DETAILED DESCRIPTION OF THE INVENTION

Figure 1:
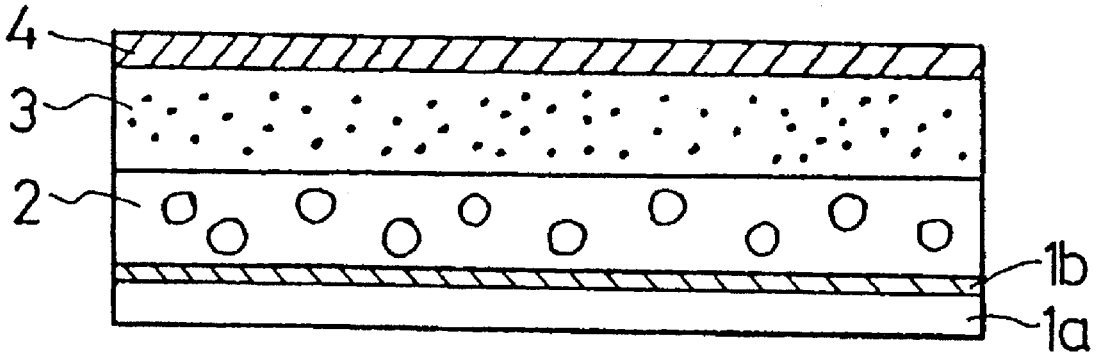
FIG. 1 is a cross-sectional view of an electroluminescent device according to the present invention.
Figure 2:
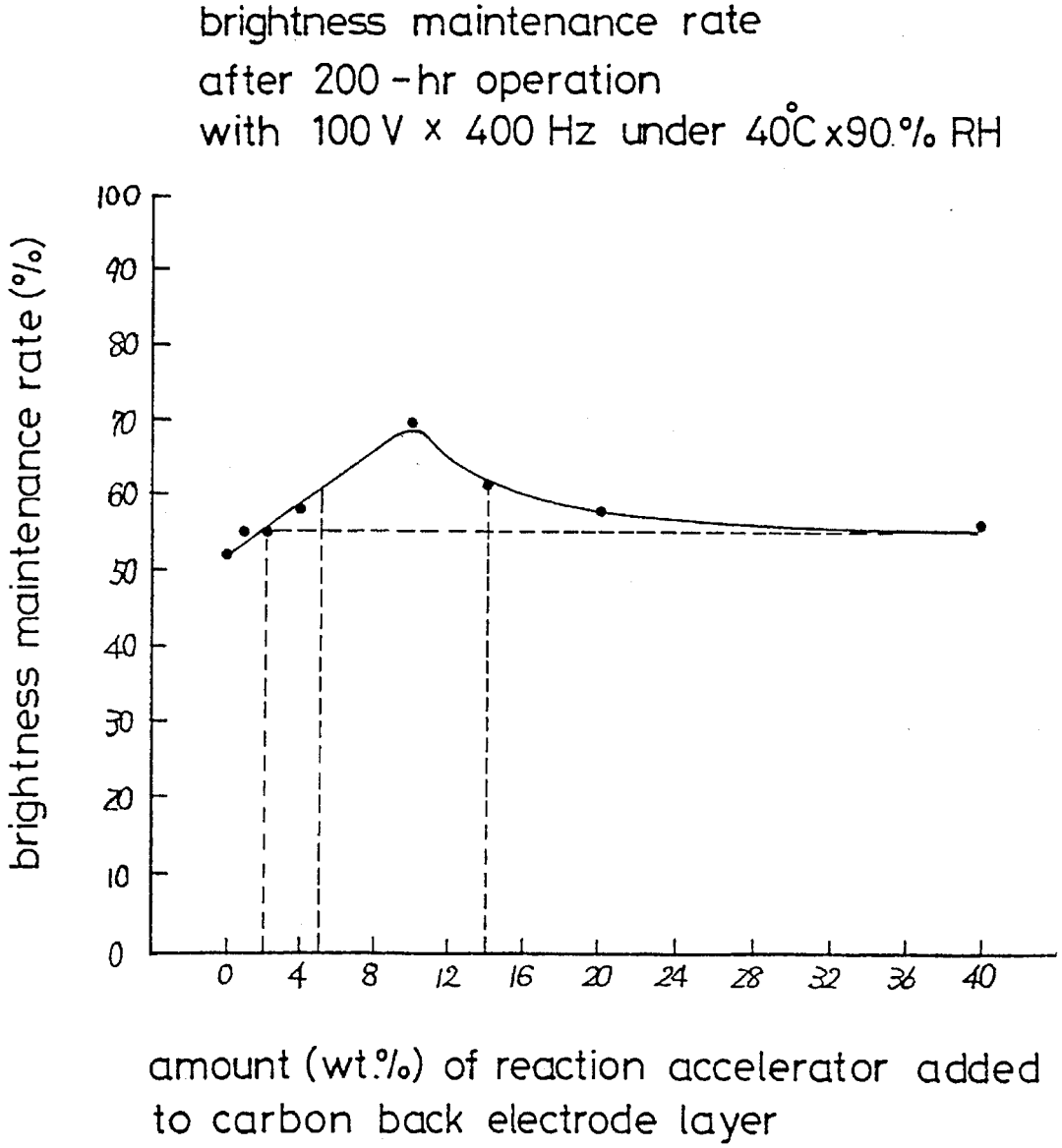
FIG. 2 is a graph illustrating the luminescent brightness maintenance characteristics of the electroluminescent device shown in FIG. 1.
Figure 3:
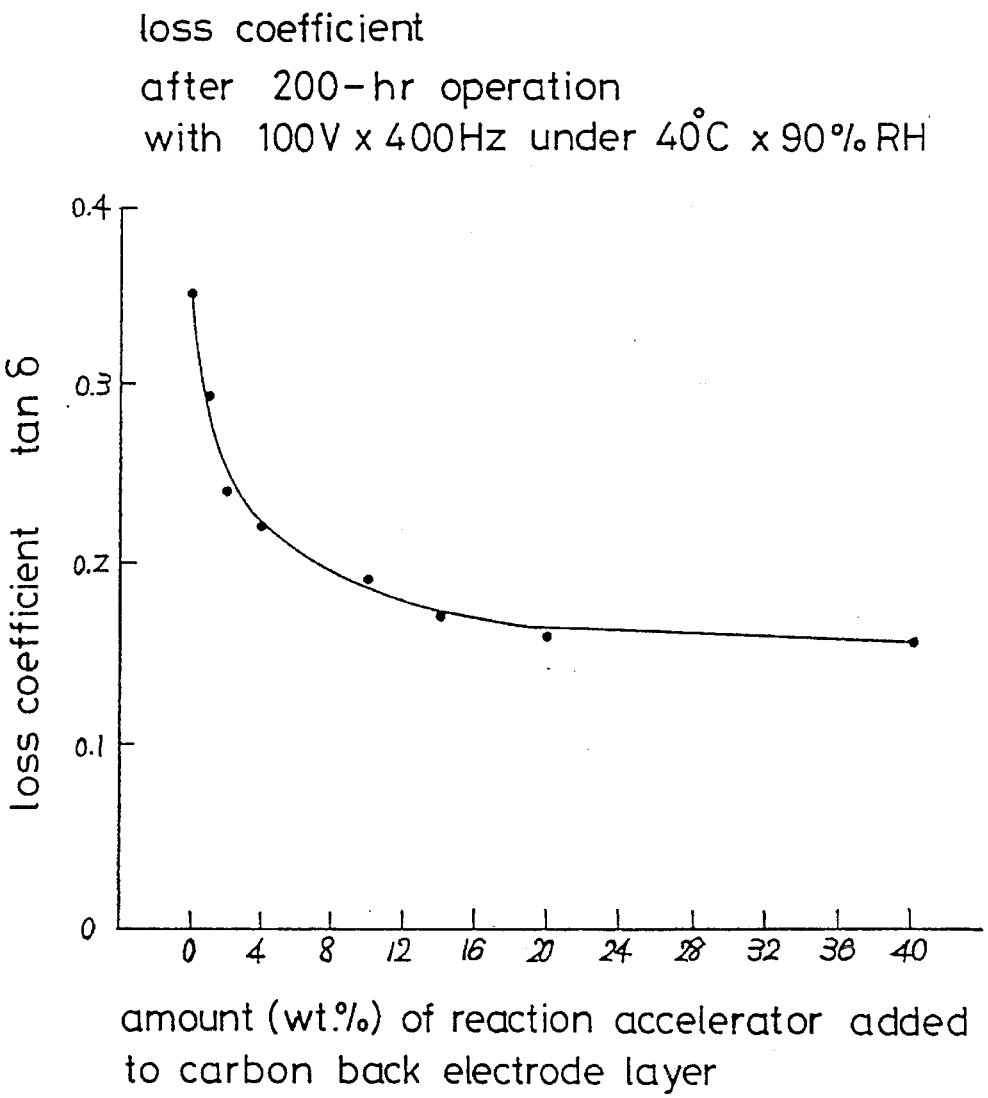
FIG. 3 is a graph illustrating the loss coefficient characteristics of the electroluminescent device shown in FIG. 1.

An electroluminescent device according to the invention is now described by referring to FIGS. 1–3. A transparent electrode layer 1*b* is formed on a transparent substrate 1*a*. A luminescent layer 2 is formed on the electrode layer 1*b*. A dielectric layer 3 is formed on the luminescent layer 2. A back electrode layer 4 is formed on the dielectric layer 3.

The transparent substrate 1*a* is made of a sheet of polyethylene terephthalate. ITO is evaporated on this substrate to form the transparent electrode layer 1*b*.

The luminescent layer 2 is formed by printing luminescent ink on the transparent electrode layer 1*b*. The luminescent ink is made up of luminescent particles. One example of the material of these particles is zinc sulfide (ZnS) doped with Cu that exhibits fluorescence. Taking account of moisture resistance, a fluoride resin binder prepared by dissolving 10 g of copolymer of vinylidene fluoride and propylene hexafluoride in a solvent, or 25 g of methyl ethyl ketone, is used together with 60 g of the luminescent particles or a fluorescent material. In use, these two kinds of materials are mixed. The luminescent ink is printed on the transparent electrode layer 1*b* by screen printing or other method, and then the ink is heated and dried, thus completing the luminescent layer 2.

Thereafter, dielectric particles of a high dielectric constant are dispersed in the fluoride resin binder and they are kneaded together, thus forming a dielectric ink. This ink is applied to the surface of the luminescent layer 2 to form a dielectric layer 3. The dielectric ink is created in the manner described now. First, barium titanate ($BaTiO_3$) having a high dielectric constant is used as dielectric particles. Then, 60 g of this barium titanate is mixed with the fluoride resin binder and they are stirred to thereby form the dielectric ink. As described above, the fluoride resin binder has been previously prepared by dissolving 10 g of copolymer of vinylidene fluoride and propylene hexafluoride in 25 g of methyl ethyl ketone, the vinylidene fluoride having excellent moisture resistance. This dielectric ink is printed on the luminescent layer 2, heated, and dried, thus forming the dielectric layer 3. The dielectric constant of the fluoride binder is low but the dielectric constant of barium titanate is very high, or 1800 F/m. Therefore, the whole dielectric layer 3 shows a high dielectric constant. Hence, the electroluminescent device does not suffer from low brightness. The proper function of this dielectric layer 3 is to enhance the electric field acting on the luminescent layer 2. In addition, the dielectric layer 3 acts as a barrier that prevents moisture from entering the luminescent layer 2.

If the copolymer (or, fluoride copolymer) of vinylidene fluoride and propylene hexafluoride is directly used in the luminescent layer 2 and in the dielectric layer 3, the moisture resistance will be improved to some extent. To improve the moisture resistance further, the following contrivances are made in the present invention.

The back electrode layer 4 is formed by mixing powdered carbon into polyester resin. The powdered carbon is an example of conductive particles. More specifically, 10 g of polyester resin is dissolved in 90 g of isophorone, or a solvent, to produce a resinous binder. Then, 80 g of powdered carbon is added to the resinous binder and they are stirred well. In this way, a conductive ink is prepared. A reaction accelerator for promoting copolymerization of the fluoride resin binder in the luminescent layer 2 and in the dielectric layer 3 is added to the conductive ink. This ink is printed on the dielectric layer 3, heated, and dried, thus forming the back electrode layer 4. The reaction accelerator added to the conductive ink, or the back electrode layer 4, permeates the dielectric layer 3 and the luminescent layer 2 from the back electrode layer 4 during the heating and drying, so that the copolymerization of the fluoride resin in the dielectric layer 3 and in the luminescent layer 2 is accelerated. As a result, the density of the fluoride resin is increased. This effectively prevents intrusion of moisture.

One appropriate example of the reaction accelerator is N-β(aminoethyl) γ-aminopropyl trimethoxysilane ($H_2NC_2H_4NHC_3H_6Si(OCH_3)_3$), which is an organic silicon monomer having two or more different kinds of reaction groups per molecule.

The organic silicon monomer having two or more different kinds of reaction groups per molecule performs other excellent functions. Specifically, one of the different reaction groups reacts with the luminescent particles which are an inorganic substance. Another reaction group reacts with the fluoride resin that is an organic substance, and becomes coupled with the resin. In this way, the organic silicon monomer acts as one kind of bonding agent and encases the electroluminescent particles in the fluoride resin. The fluoride resin prevents moisture from entering the electroluminescent particles. Similarly, the dielectric particles of a high dielectric constant is encased in the fluoride resin. The fluoride resin prevents moisture from entering the dielectric particles. In consequence, the moisture resistance of the whole electroluminescent device is improved greatly. Data about the amount of the added reaction accelerator, or bonding agent, in the back electrode layer 4 are listed in Table 1.

TABLE 1

| sample | amount (wt. %) of bonding agent added to carbon back electrode layer | brightness (100V × 400 Hz (cd/m²)) |
|---|---|---|
| a | 0 | 63.2 |
| b | 1.0 | 60.5 |
| c | 2.0 | 58.1 |
| d | 4.0 | 62.0 |
| e | 10.0 | 60.6 |
| f | 14.0 | 61.0 |
| g | 20.0 | 61.9 |
| h | 40.0 | 60.7 |

Another reaction accelerator consisting of an organic silicon monomer having two or more different kinds of reaction groups per molecule is γ-glycidexypropyltrimethoxysilane given by

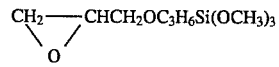

Anhydrotrimellitate given by.

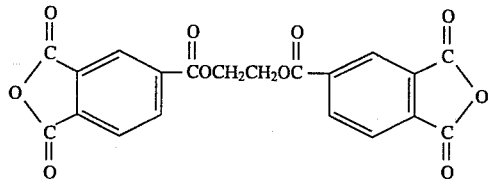

is a reaction accelerator which is neither an organic silicon monomer nor has two or more kinds of reaction groups per molecule.

The electroluminescent device fabricated in this way was operated so as to emit light for 200 hours with 100 V×400 Hz and with 40° C.×90% RH (relative humidity). Luminescent brightness maintenance characteristics as shown in FIG. 2 and loss coefficient tan δ characteristic (FIG. 3) that is one of electrical characteristics of the electroluminescent device were obtained.

As can be seen from FIG. 2, the addition of the reaction accelerator has improved the brightness maintenance characteristics over the whole range compared with the case in which no reaction accelerator is added (the amount of addition is 0%). If the amount of the reaction accelerator added is in excess of 2% by weight, then a substantial improvement arises. Especially, if the amount of the-reaction accelerator added is in the range from 5 to 14% by weight, then the brightness maintenance characteristics are improved greatly.

It can be seen from FIG. 3 that as the amount of the reaction accelerator added to the back electrode layer is increased, the loss coefficient tan δ decreases. This means that less moisture is absorbed, i.e., the moisture resistance is improved. In this way, we have confirmed that the addition of the reaction accelerator improves the characteristics greatly.

It may be contemplated to add a vulcanizing agent as a reaction accelerator for the vinylidene fluoride and propylene hexafluoride so as to induce vulcanization when the luminescent layer and the dielectric layer are formed. The vulcanizing agent is typified by peroxides. If the fluoride resin is vulcanized, the moisture resistance is improved somewhat but not high enough to make moisture-proof film unnecessary. Also, the luminescent brightness of the electroluminescent device is halved by the vulcanization. This is a fatal problem.

In the example described above, a fluoride resin is dissolved in a solvent to create a fluoride resin binder. Luminescent particles are added to the binder, thus creating a luminescent ink. This luminescent ink is printed on the transparent electrode layer 1*b*, heated, and dried. Thus, the luminescent layer is formed. As soon as a reaction accelerator is added to the luminescent ink, polymerization of the fluoride resin is started even at room temperature. As a result, the luminescent ink cures in a short time. It is substantially impossible to print the luminescent ink. A similar phenomenon is observed regarding the dielectric ink.

In the present example, the fluoride resin binder used in the luminescent layer and in the dielectric layer may be made from polyvinylidene fluoride, i.e., polymer of vinylidene fluoride. Alternatively, the fluoride resin binder is made from a copolymer of vinylidene fluoride and other copolymerizable fluoride resin (e.g., at least one of ethylene fluoride, vinyl fluoride, ethylene trifluoride, ethylene chloride trifluoride, ethylene tetrafluoride, and propylene hexafluoride). Zinc sulfide doped with Cu has been used as the luminescent particles. These particles may be previously coated with a transparent inorganic dielectric substance such as $SiO_2$, $TiO_2$, and $Al_2O_3$.

Furthermore, in the present example, the back electrode layer may be coated with a moisture-proof layer consisting of a fluoride resin. In particular, 10 g of copolymer of vinylidene fluoride and propylene hexafluoride is dissolved in 25 g of methyl ethyl ketone to create a fluoride resin ink. This ink is printed on the back electrode layer, heated, and dried. Thus, a moisture-proof layer consisting of the fluoride resin is created. This further enhances the moisture resistance. Examples of the fluoride resin used in the moisture-proof layer formed on the back electrode layer include copolymers of two or more of ethylene fluoride, vinyl fluoride, vinylidene fluoride, ethylene trifluoride, ethylene chloride trifluoride, ethylene tetrafluoride, and propylene hexafluoride and copolymers of these monomers. The resinous material of the moisture-proof layer can consist of other resins such as polyester resins, acrylic resins, and vinyl resins.

Additionally, moisture-proof film may be stuck on the outer surface of the transparent substrate and on the outer surface of the back electrode layer. This further enhances the moisture resistance.

Another electroluminescent device according to the invention is next described by referring to FIGS. 4–7. A transparent substrate 11 has a transparent electrode layer 11*a* on which a luminescent layer 12 is formed. A dielectric layer 13 is formed on top of the luminescent layer 12. A back electrode layer 14 is formed on the top surface of the dielectric layer 13. The back electrode layer 14 has an end portion retreated a slight distance (e.g., 1 mm) inwardly from the end of the electroluminescent device, or the luminescent layer 12. The top surface of the back electrode layer 14 is coated with a protective layer 15 having an end portion which is formed integrally with the end portion of the electroluminescent device. Therefore, the outer peripheral portion of the protective layer 15 is joined to the outer peripheral portion of the dielectric layer 13. The transparent substrate 11, the luminescent layer 12, and the dielectric layer 13 are exactly the same as their counterparts 1, 2, and 3, respectively, of the example described already in conjunction with FIGS. 1–3 and so these layers 11–13 are not described here.

The material of the back electrode layer 14 formed on the dielectric layer 13 is created by mixing powdered carbon that is conductive particles into polyester resin. More specifically, 10 g of polyester resin is dissolved in 90 g of isophorone, or a solvent, to produce a resinous binder. Then, 80 g of powdered carbon is added to the resinous binder and they are stirred well. In this way, a conductive ink is prepared. This ink is printed on the dielectric layer 13, heated, and dried, thus forming the back electrode layer 14.

Figure 7:
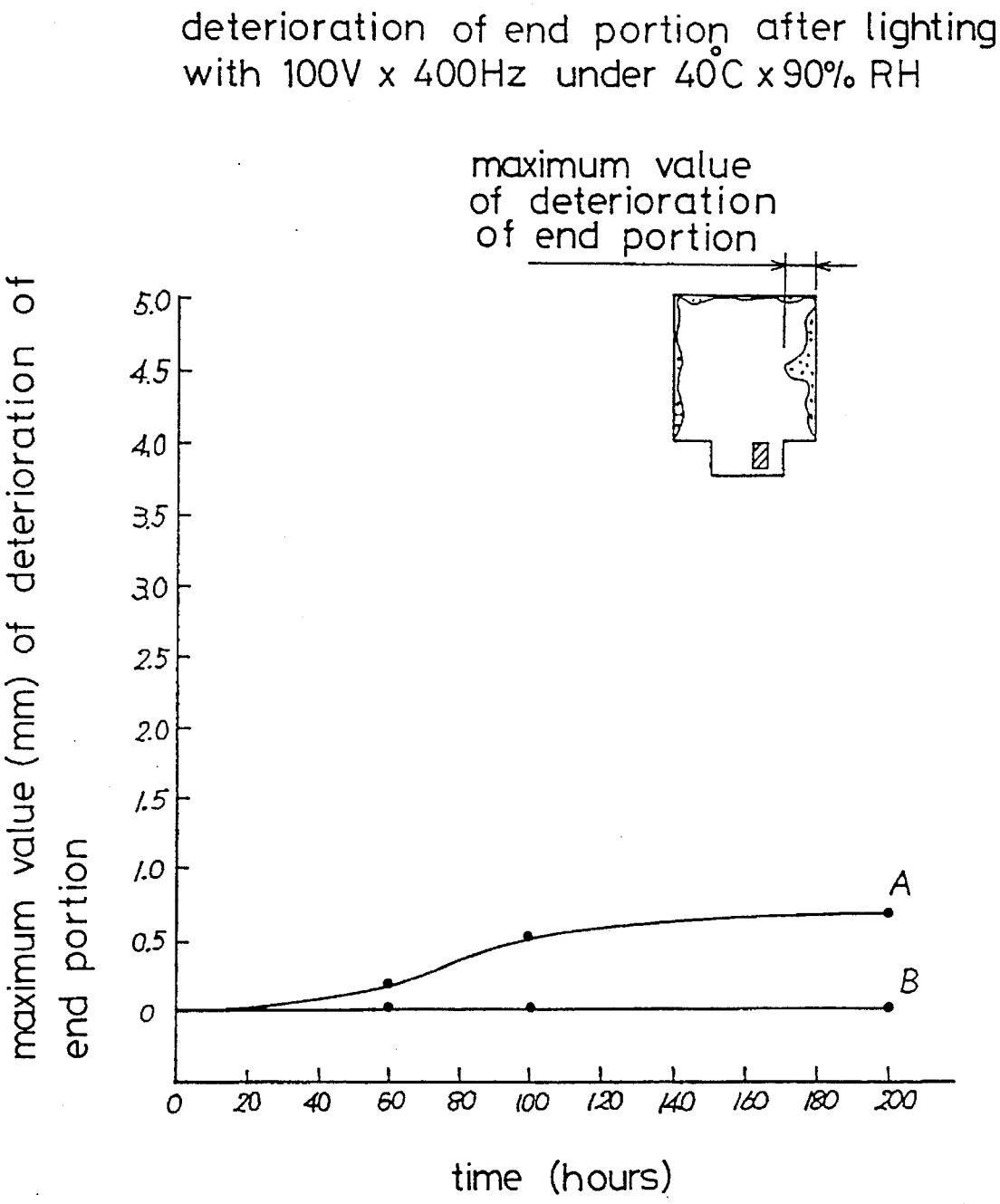
FIG. 7 is a graph illustrating the end deterioration characteristics of a protective layer shown in FIG. 4.

The back electrode layer 14 has an end portion retreated a distance of 1 mm inwardly from the end of the electroluminescent device, or the ends of the luminescent layer 12 and of the dielectric layer 13, for the reason described later in connection with FIG. 7.

The outer surface of the back electrode layer 14 is coated with the protective layer 15. For this purpose, a protective ink is created by dissolving vinyl chloride resin in a solvent consisting of butyl acetate. This protective ink contains 2.0% by weight of the reaction accelerator for promoting polymerization of the fluoride resin used in the luminescent layer 12 and in the dielectric layer 13.

This protective ink containing the reaction accelerator is printed on the back electrode layer 14, heated, and dried. During the heating and drying of the protective layer 15, the reaction accelerator permeates the dielectric layer 13 and the luminescent layer 12 so that the copolymerization of the fluoride resin in the dielectric layer 13 and in the luminescent layer 12 is accelerated. As a result, the density of the fluoride resin is increased. This effectively prevents intrusion of moisture. Hence, the moisture resistance is improved greatly.

Since the same reaction accelerator as used in the example described already in connection with FIGS. 1–3 is employed, the accelerator is not described here.

The electroluminescent device fabricated in this way was operated so as to emit light for 200 hours with 100 V×400 Hz and with 40° C.×90% RH (relative humidity). Luminescent brightness maintenance characteristics as shown in FIG. 5 and loss coefficient tan δ characteristic as shown in FIG. 6 were obtained, the tan δ characteristic being one of electrical characteristics of the electroluminescent device.

Figure 5:
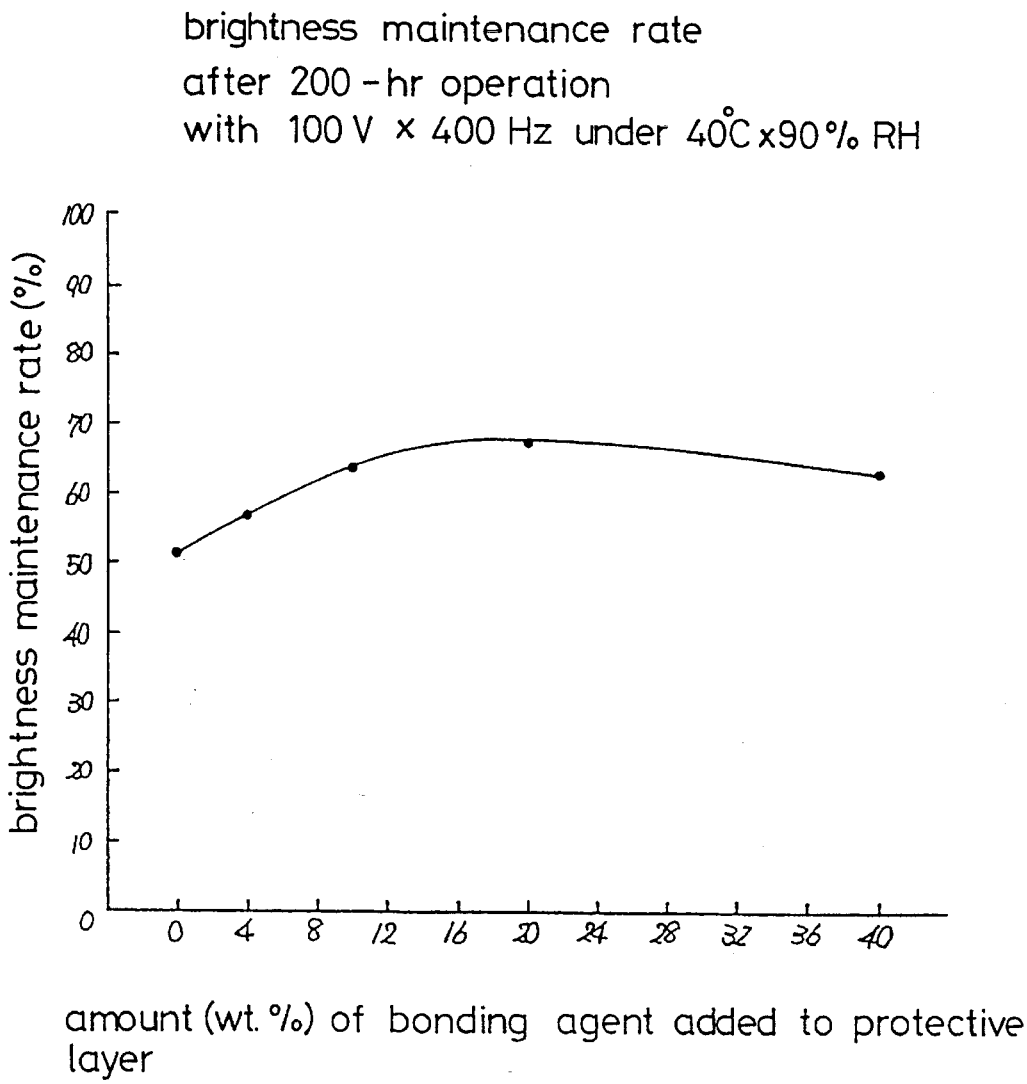
FIG. 5 is a graph illustrating the luminescent brightness maintenance characteristics of the electroluminescent device shown in FIG. 4.

As can be seen from FIG. 5, the addition of the reaction accelerator has improved the brightness maintenance characteristics over the whole range compared with the case in which no reaction accelerator is-added (the amount of addition is 0%). If the amount of the reaction accelerator added is in excess of 2% by weight, then a substantial improvement arises. Especially, if the amount of the reaction accelerator added is in the range from 10 to 40% by weight, then the brightness maintenance characteristics are improved greatly.

Figure 6:
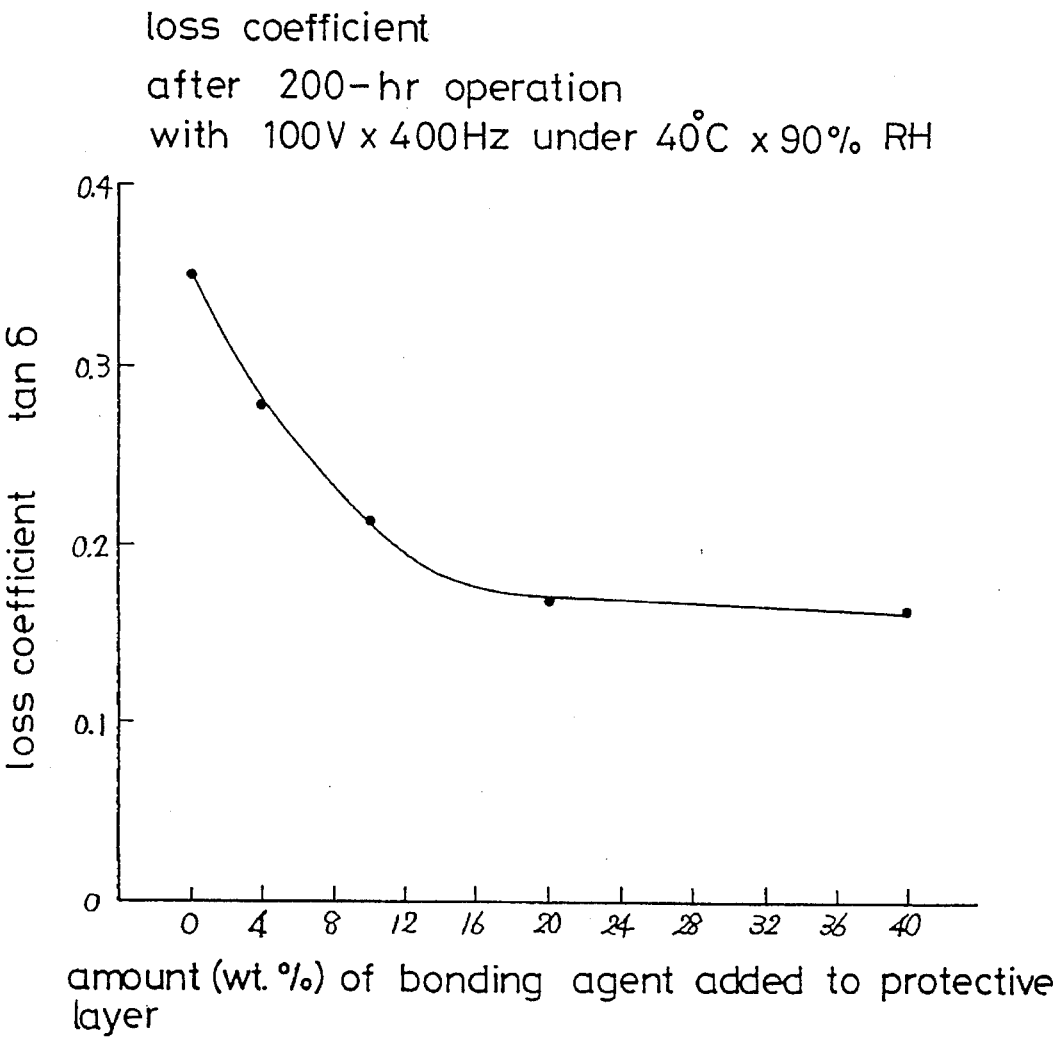
FIG. 6 is a graph illustrating the loss coefficient characteristics of the electroluminescent device shown in FIG. 4.

As can be seen from FIG. 6, as the amount of the reaction accelerator added is increased, the loss coefficient tan δ decreases. This means that less moisture is absorbed, i.e., the moisture resistance is improved. In this way, we have confirmed that the addition of the reaction accelerator to the protective layer 15 improves the moisture resistance.

Figure 4:
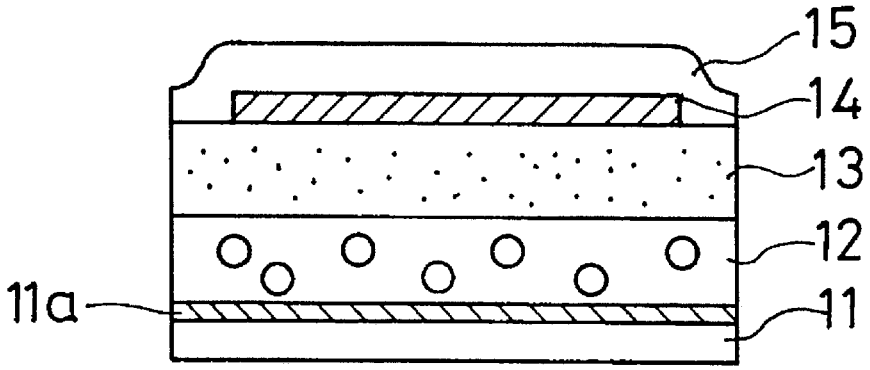
FIG. 4 is a cross-sectional view of another electroluminescent device according to the present invention.

As shown in FIG. 4, the back electrode layer 14 has an end portion that is retreated a distance of 1 mm inwardly from the end of the electroluminescent device, for the reason described now. Two electroluminescent devices A and B were fabricated. These two devices were similar except for the following points. In the device A, the distance of retreat from the end of the electroluminescent device to the end of the back electrode layer was 0 mm, and 10% by weight of a bonding agent was added to the back electrode layer. In the device B according to the present invention, the distance of retreat from the end of the electroluminescent device to the end of the back electrode layer was 1.0 mm, and 20% by weight of a bonding agent was added to the protective layer. These two devices were operated so as to emit light for 200 hours with 100 V×400 Hz and with 40° C.×90% RH (relative humidity). Deteriorations of the end portions as shown in FIG. 7 were observed. As can be seen from FIG. 7 that in the electroluminescent device A in which the distance of retreat is 0 mm, the maximum value of the deterioration of the end portion of the luminescent region is about 0.7 mm. In the electroluminescent device B in which the distance of retreat is 1.0 mm, the end portion of the luminescent region is not deteriorated at all. Since the end portions of the luminescent layer 12 and of the dielectric layer 13 are not deteriorated, the image displayed is not adversely affected.

In the example described in connection with FIGS. 3–7, the resinous binder in the back electrode layer 14 may also consist of a fluoride resin. More specifically, 10 g of copolymer of vinylidene fluoride and propylene hexafluoride is dissolved in 90 g of isophorone, or a solvent, to produce a fluoride resin binder. Then, 80 g of powdered carbon is added to the resinous binder and they are stirred well. In this way, a conductive ink is prepared. This ink is printed on the dielectric layer 13, heated, and dried, thus forming the back electrode layer 14, in the same way as in the above-described method.

Where the back electrode layer 14 contains no fluoride resin, a conductive ink containing 2.0% by weight of a reaction accelerator consisting of an organic silicon monomer is prepared. The silicon monomer has two or more different kinds of reaction groups per molecule. This conductive ink is printed on the dielectric layer 13, heated, and dried to form the back electrode layer 14, in the same manner as the method described above.

Moreover, the electroluminescent device may be sealed by moisture-proof film. This further enhances the moisture resistance.

As described thus far, in the present invention, a luminescent layer and a dielectric layer are interposed between a transparent electrode layer and a back electrode layer. The luminescent layer comprises a resinous binder containing electroluminescent particles. The dielectric layer comprises a resinous binder containing dielectric particles. The back electrode layer comprises a resinous binder containing conductive particles. In this electroluminescent device, the resinous binder of at least one of the luminescent layer and the dielectric layer is made from a fluoride resin. The back electrode layer contains a reaction accelerator for promoting polymerization of the fluoride resin binder. The reaction accelerator permeates the dielectric layer and the luminescent layer from the back electrode layer. This accelerates polymerization of the fluoride resin in the dielectric layer and in the luminescent layer, thus increasing the density of the fluoride resin. Also, intrusion of moisture is prevented. Therefore, even if moisture-proof film is omitted, the electroluminescent device can have high moisture resistance.

In another electroluminescent device according to the present invention, a luminescent layer and a dielectric layer are interposed between a transparent electrode layer and a back electrode layer. The luminescent layer comprises a resinous binder containing electroluminescent particles. The dielectric layer comprises a resinous binder containing dielectric particles. The back electrode layer comprises a resinous binder containing conductive particles. In this electroluminescent device, the resinous binder of at least one of the luminescent layer, the dielectric layer, and the back electrode layer is made from a fluoride resin. The protective layer contains a reaction accelerator for promoting polymerization of the fluoride resin. The reaction accelerator permeates the dielectric layer and the luminescent layer from the back electrode layer to thereby promote polymerization of the fluoride resin, thus increasing the density of the fluoride resin. Also, intrusion of moisture is prevented. Therefore, even if moisture-proof film is omitted, the electroluminescent device can have high moisture resistance.

Since expensive moisture-proof film can be omitted, the thickness of the electroluminescent device can be reduced. Hence, the flexibility of the device can be improved. Furthermore, a sealing step can be dispensed with. Hence, an inexpensive electroluminescent device can be provided.

The end portion of the back electrode layer is retreated inwardly from the end of the electroluminescent device. Since the end portions of the luminescent layer and of the dielectric layer are not deteriorated, the image displayed is not adversely affected.

What is claimed is:

1. An electroluminescent device comprising:

a transparent electrode layer;

a back electrode layer comprising a resinous binder that contains conductive particles;

a luminescent layer formed between said transparent electrode layer and said back electrode layer and comprising a resinous binder that contains electroluminescent particles;

a dielectric layer formed between said transparent electrode layer and said back electrode layer and comprising a resinous binder that contains dielectric particles;

said resinous binder of at least one of said luminescent layer and said dielectric layer being made from a fluoride resin; and a reaction accelerator contained in said back electrode layer for promoting polymerization of said fluoride resin binder.

2. The electroluminescent device of claim 1, wherein said reaction accelerator is an organic silicon monomer having two or more different kinds of reaction groups per molecule.

3. The electroluminescent device of claim 1, wherein said back electrode layer contains more than 2% by weight of said reaction accelerator.

4. The electroluminescent device of claim 1, wherein said back electrode layer has an end portion retreated slightly from an end portion of the electroluminescent device.

5. An electroluminescent device comprising:

a transparent electrode layer;

a back electrode layer comprising a resinous binder that contains conductive particles;

a luminescent layer formed between said transparent electrode layer and said back electrode layer and comprising a resinous binder that contains electroluminescent particles;

a dielectric layer formed between said transparent electrode layer and said back electrode layer and comprising a resinous binder that contains dielectric particles;

said resinous binder of at least one of said luminescent layer, said dielectric layer, and said back electrode layer being made from a fluoride resin;

a protective layer formed on an outer surface of said back electrode layer and made from an electrically insulating resin; and a reaction accelerator contained in said protective layer for promoting polymerization of said fluoride resin.

6. The electroluminescent device of claim 5, wherein said reaction accelerator is an organic silicon monomer having two or more different kinds of reaction groups per molecule.

7. The electroluminescent device of claims 5, wherein said back electrode layer has an end portion retreated slightly from an end portion of the electroluminescent device.

* * * * *